US006073522A

United States Patent [19]

Carnesi

[11] Patent Number: 6,073,522

[45] Date of Patent: Jun. 13, 2000

[54] ADJUSTABLE SOCKET

[76] Inventor: Thomas Carnesi, 1309 Manuel Ave., Torrance, Calif. 90501

[21] Appl. No.: 09/399,487

[22] Filed: Sep. 20, 1999

Related U.S. Application Data

[60] Provisional application No. 60/103,664, Oct. 9, 1998.

[51] Int. Cl.[7] ..... B25B 13/18

[52] U.S. Cl. ..... 81/128; 279/114

[58] Field of Search ..... 81/128, 129; 279/66, 279/110, 114

[56] References Cited

U.S. PATENT DOCUMENTS

| | | | |
|---|---|---|---|
| 51,384 | 12/1865 | Cushman . | |
| 877,773 | 1/1908 | Holm . | |
| 1,288,154 | 12/1918 | Palmgren . | |
| 1,425,213 | 8/1922 | Palmgren . | |
| 1,503,635 | 8/1924 | Butler . | |
| 2,742,297 | 4/1956 | Bilz . | |
| 2,778,260 | 1/1957 | Jovanovich . | |
| 2,884,826 | 5/1959 | Bruhn . | |
| 3,209,624 | 10/1965 | Shiffman . | |
| 3,664,213 | 5/1972 | Anati . | |
| 3,724,299 | 4/1973 | Nelson . | |
| 4,378,714 | 4/1983 | Colvin | 81/128 |
| 4,663,999 | 5/1987 | Colvin . | |
| 4,884,480 | 12/1989 | Briese . | |
| 4,892,016 | 1/1990 | Anderson . | |
| 5,207,129 | 5/1993 | Fossella . | |
| 5,337,634 | 8/1994 | Carnesl . | |
| 5,540,124 | 7/1996 | Srhoj . | |
| 5,819,607 | 10/1998 | Carnesl . | |

*Primary Examiner*—James G. Smith

*Attorney, Agent, or Firm*—John J. Connors; Connors & Assoc

[57] ABSTRACT

An adjustable socket has a number of selectable socket size openings available. It includes a drive member, an indexing collar positioned within the drive member, and an axially moveable drive core positioned within the drive member that is manually rotatable to different positions corresponding to the selected socket size openings. There are a series of teeth on the drive core and the drive core has a cam surface with guide elements. Jaw members mounted to the drive member to move laterally between fixed lateral positions upon rotation of the drive core, each fixed lateral position corresponding to a selected socket size opening. Each jaw member has a cam that engages one of the guide elements in the cam surface, so that with the drive core in a first axial position it is enabled to be rotated, thereby causing the jaw members to move laterally to a selected socket size, and in a second axial position the teeth of the drive core and the teeth of the indexing collar interlocked to be maintained the selected socket size.

11 Claims, 7 Drawing Sheets

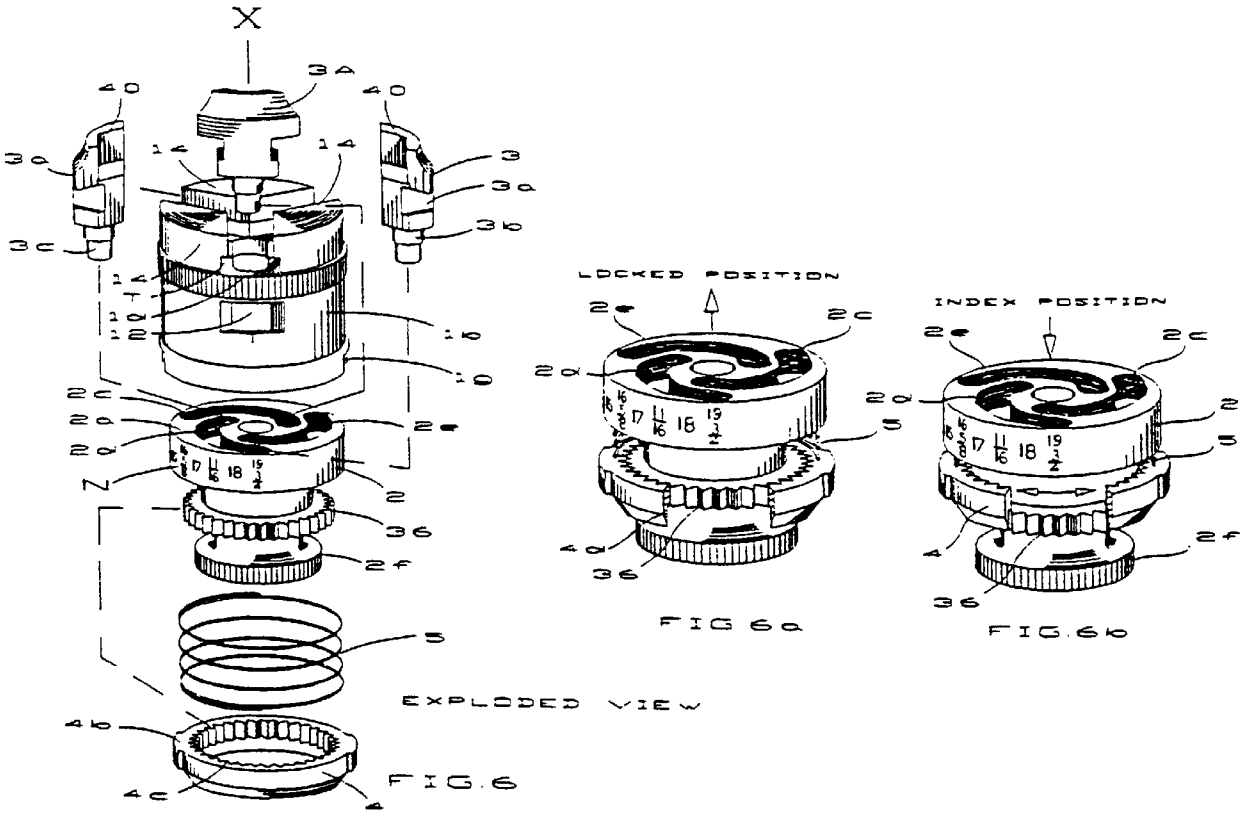
FIG. 6b
FIG. 6a
FIG. 6
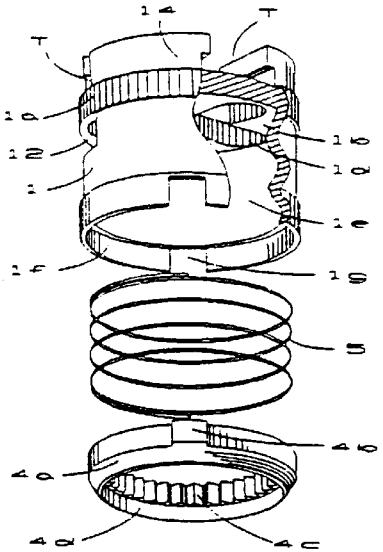
FIG. 5

ADJUSTABLE SOCKET

RELATED APPLICATION

This application is a utility patent application based on U.S. provisional patent application Ser. No. 60/103,664, filed Oct. 9, 1998, entitled "Adjustable Socket," which is incorporated herein by reference and made a part of this application.

BACKGROUND OF THE INVENTION

In U.S. Pat. No. 5,337,634, there is disclosed a socket which is manually adjustable to enable the socket to grip nuts or bolts with hexagonal heads of different sizes. In this socket there are a plurality of jaws which are adjustably spaced apart to grip a hexagonal bolt head of a selected size. Although this socket allows a user to make the necessary adjustments, it includes many parts that add to the cost of manufacturing this socket.

SUMMARY OF THE INVENTION

This invention has several features, no single one of which is solely responsible for its desirable attributes. Without limiting the scope of this invention as expressed by the claims that follow, its more prominent features will now be discussed briefly. After considering this discussion, and particularly after reading the section entitled, "DETAILED DESCRIPTION OF THE PREFERRED EMBODIMENTS," one will understand how the features of this invention provide its benefits, which include, but are not limited to: convenience of use, minimum number of parts, compactness enabling its use in limited working spaces, and when storing, especially for the handyman or sports enthusiast who may not wish to carry an entire set of individual sockets around, improved torque strength, a visual selector for selecting one of several available size adjustments and providing a numeric indication of size to the user. and an overall length (1.560 inches) that remains constant when adjusting to any hex sizes.

The first feature of the adjustable socket of this invention is that it provides a number of selectable socket size openings available. It includes a drive member having a longitudinal axis. Preferably, the drive member is a hallow cylinder having a top end, closed at least partially by a wall with a plurality of slots therein, and an open bottom end.

The second feature is an indexing collar, preferably ring shaped. It is positioned within the drive member near the bottom end of the drive member. This indexing collar has a central opening with an inner circular surface with a series of teeth thereon.

The third feature is an axially moveable drive core positioned within the drive member beneath the closed wall of the drive member. It is also manually rotatable to different positions corresponding to the selected socket size openings, and it has a lower wall portion extending into the central opening of the indexing collar and a head portion that fits snugly within the drive member. The head portion has a substantially flat cam surface that is substantially at a right angle to the longitudinal axis. There are guide elements on the cam surface, preferably slots arranged in a spiral configuration. The lower wall portion of the drive core has a series of teeth adapted to disengage the teeth on the inner circular surface when the drive core is in a first axial position and to engage the teeth on the inner circular surface when the drive core is in a second axial position.

The fourth feature is that there are plurality of jaw members mounted to the top end of the drive member to move laterally between fixed lateral positions upon rotation of the drive core. Each fixed lateral position corresponds to a selected socket size opening. Each jaw member having a cam follower extending therefrom that engages one of the guide elements in the cam surface. With the drive core in the first axial position it is enabled to be rotated, thereby causing the jaw members to move laterally to a selected socket size. In the second axial position, the teeth of the drive core and the teeth of the indexing collar are interlocked to maintain the selected socket size.

The fifth feature is that there is a spring member that normally forces the drive core and the collar member into a position where the teeth of the drive core and the teeth of the indexing collar engage.

The sixth feature is that there are visible indicia associated with each selectable position to indicate the selected socket size openings.

BRIEF DESCRIPTION OF THE DRAWING

The preferred embodiments of this invention, illustrating all its features, will now be discussed in detail. These embodiments depict the novel and non-obvious socket of this invention as shown in the accompanying drawing, which is for illustrative purposes only. This drawing includes the following figures (FIGS.), with like numerals indicating like parts:

FIG. 5 is an exploded perspective view, with sections broken away, showing the interior of the barrel 1 of the first embodiment of the adjustable socket of the present invention.

FIG. 6 is an exploded perspective view showing all of the major components of the first embodiment of the adjustable socket of the present invention.

FIG. 6*a* is a perspective view, with sections broken away, of the drive core shown in the locked position.

FIG. 6*b* is a perspective view, with sections broken away, of the drive core shown in the indexing or unlocked position.

DETAILED DESCRIPTION OF THE PREFERRED EMBODIMENTS

First Embodiment

Figure 4:
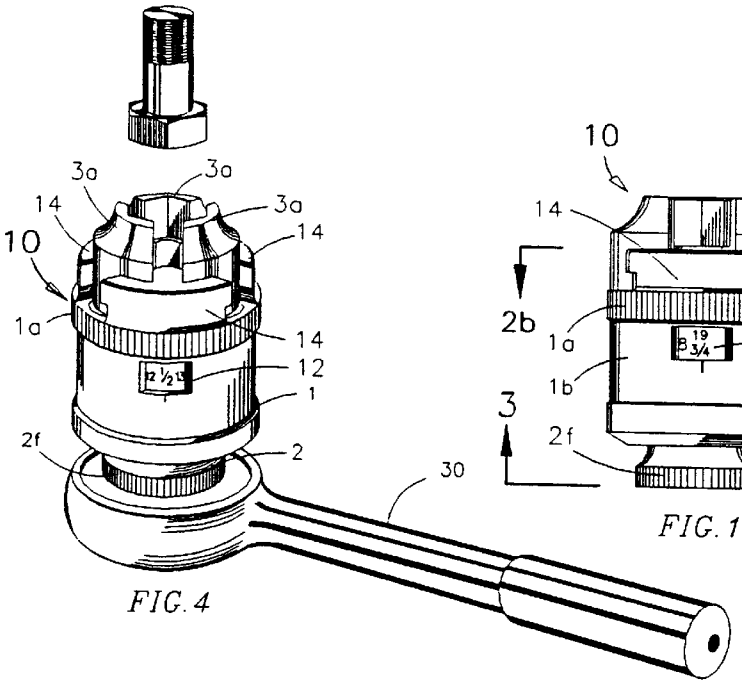
FIG. 4 is a perspective view of the first embodiment of the adjustable socket of the present invention attached to a standard ratchet for turning the socket.
Figure 11:
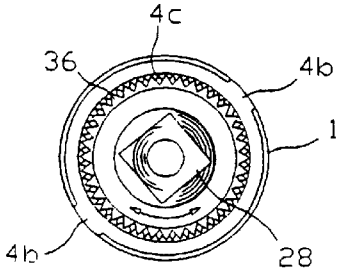
FIG. 11 is a bottom view taken along line 11—11 of FIG. 9 showing the serrated index teeth of socket core 2 disengaged from the serrated teeth of index collar 4 as shown in FIG. 9.
Figure 12:
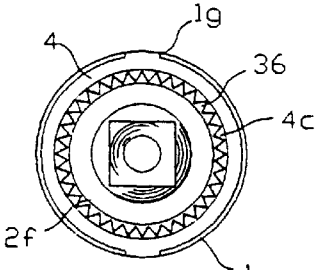
FIG. 12 is a bottom view taken along line 12—12 of FIG. 10 showing the serrated index teeth of core 2 and index teeth of collar 4 engaged as shown in FIG. 10.

As best show in FIGS. 4 and 6, the first embodiment of this invention, the adjustable socket 10, includes a hollow drive barrel 1, three gripping jaws 3 carried by the drive barrel, a drive core 2 having a top flat cam surface 2*a* with spirally arranged slots 2*c*, 2*d*, 2*e* therein, and an index collar 4 engaging the drive core in a locked mode and disengaging the drive core in an unlocked mode. Each gripping jaw 3 has pins or cam followers 3*b* with nipple ends 3*c* extending downward from the followers 3*b* of the gripping jaws.

As best shown in FIG. 6, the drive barrel 1, the drive core 2, an index spring 5, and the index collar 4 are axially aligned along the longitudinal axis X of the socket 10, and the gripping jaws 3 are radially displaced from the longitudinal axis X. There is a counter bore portion if inside the barrel 1 into which the index collar is press fitted, and two notches 1*g* in the side wall of the barrel 1 are aligned so that they interlock with a pair of ears 4*b* of index collar 4 to prevent slippage due to torque between the collar 4 and the drive barrel 1. The distance from the longitudinal axis X of these gripping jaws 3 is varied depending on the size of the hexagonal head of the nut or bolt being grasped by the socket 10. The exterior surface 2*f* of the drive core 2 is knurled to improve gripping. The drive core 2 has serrated teeth 36 that engage the serrated teeth 4*c* of the collar 4 when the drive core 2 is in the locked mode.

Figure 2B:
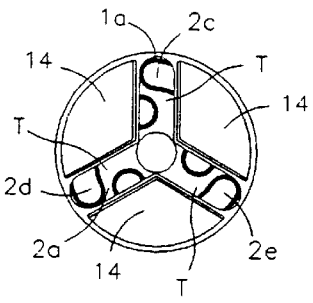
FIG. 2*b* is a cross sectional view taken along 2*b*—2*b* of FIG. 1 with jaws removed partially exposing the cam slots 2*a*, 2*b*, and 2*c* through three equally spaced T-slots formed at the top of barrel
Figure 2A:
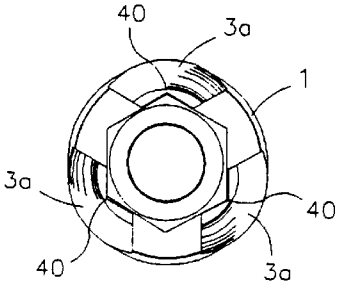
FIG. 2*a* is the top plan view of the first embodiment of the adjustable socket of the present invention showing a three jaw configuration in the process of gripping a standard hexagonal bolt head.
Figure 3:
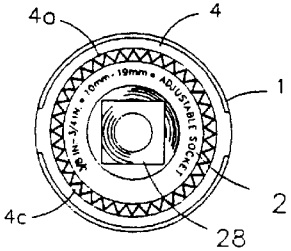
FIG. 3 is the bottom view taken along line 3—3 of FIG. 1 of the first embodiment of the adjustable socket of the present invention showing the ⅜ inch square drive slot within the core 2 and the serrated index collar 4.
Figure 1:
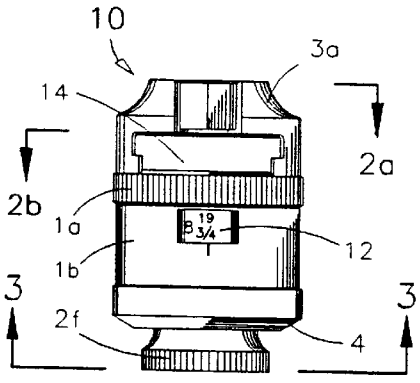
FIG. 1 is a side view of the first embodiment of the adjustable socket of the present invention.

As best shown in FIG. 2*b*, the drive barrel 1 has three equally spaced, wedge shaped fingers 14 at its upper end, with one jaw 3 being positioned within a T-channel T between adjacent fingers. Upon assembly, the central bored out portion 1*e* of barrel 1 houses the drive core 2, index spring 5, and index collar 4. As shown in FIG. 1, there is a rectangular window 12 near the base 1*b* of the drive barrel 1 and a knurled rim 1*a* near the top of the drive barrel 1. The central portion of barrel 1 is bored out to a depth that provides for sufficient thickness of an end wall 1*b* to maintain structural integrity of barrel 1. The end wall 1*b* of barrel 1 has three through slots 1*d* which are equally and radially spaced. The inside of each of the jaws 3 is formed into a 120 degree V-notch 40 in order to accommodate hexagonally configured bolts. The intermediate portion 3*a* of each jaw 3 is configured into a block shape which corresponds to and rides laterally within the T-channels T formed at the top of barrel 1. Each of the T-channels has the slot id through wall 1*b*. These slots 1*d* are sized to allow each aligned follower 3*b* of the jaw members 3 to extend through an individual slot id and ride within individual cam grooves 2*c*, 2*d* or 2*e* of drive core 2.

The drive core 2 has on the upper exterior of its side 2*c* a series of numbers N in a row which correspond to the different size hexagonal heads of bolts the socket 10 is designed to grip. By pulling the knurled portion 2*f* of core 2 downwards while simultaneously gripping the knurled rim 1*a* of the barrel 1 and rotating the core 2, the series of numbers N move sequentially past the window 12. The number N appearing in window 12 indicates to the user that the jaws 3 are positioned to grasp a hexagonal bolt head of the same size as the number N which appears in the window. For example, if the number ¾ appears in the window 12, the jaws 3*a* are positioned to grasp a hexagonal head having a diameter of ¾ inch across the flat of the hex nut. The setting of the jaws 3 is such that hexagonal heads sized in both English and Metric units may be grasped by the socket 10. For example, the socket may accommodate head sizes ranging between ⅜ to ¾ inch and 10 to 19 millimeters (mm) in integrated sequential order. The numbers N appear as graduations stamped in sequential order as follows: ⅜ inch, 10 mm, (11 mm/7/16 inch), 12 mm, 13 mm, ½ inch, 14 mm, 9/16 inch, 15 mm, (16 mm/5/8 inch), 17 mm, 11/16 inch, 18 mm and (19 mm/¾ inch). Because the (11 mm/7/16 inch), (16 mm/⅝ inch), and (19 mm/¾ inch) are radially within ANSI specifications, they are incorporated into one size setting. These noted sizes are visible through the rectangular slotted window 12 upon rotating the core 2.

Figure 7:
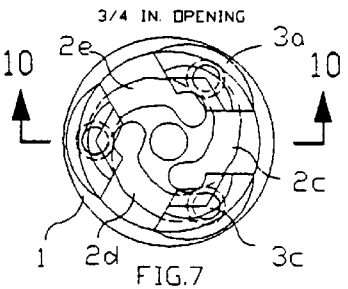
FIG. 7 is a top view showing in phantom the jaw members 3 set in cam slots 2*c*, 2*d* and 2*e* at ¾ inch opening.
Figure 8:
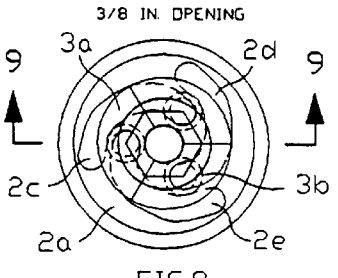
FIG. 8 is the same view as FIG. 7, except when the jaw members 3 are adjusted to a ⅜ inch opening.

When the user pulls the core 2 downwards using the knurled exterior surface 2*f* of the drive core 2, the serrated male teeth 36 of core 2 disengage from the female teeth 4*c* of index collar 4. That is the socket 10 changes from a locked mode, as best shown in FIG. 6*a*, to an indexing or unlocked mode, as best shown in FIG. 6*b*. In the unlocked mode, the drive core 2 is free to b e manually rotated within barrel 1 and a counterbore 4*d* of the index collar 4. The counterbore 4*d* of the index collar 4 maintains constant alignment of the core 2 with the longitudinal X axis of socket 10. The nipple ends 3*c* of the cam followers 3*b* of each of the jaw members 3 is in constant engagement with the spirally configured cam grooves 2*c*, 2*d* and 2*e* of the core 2. The radial configuration of the cam grooves 2*c*, 2*d* and 2*e* become smaller when the drive core 2 rotated in a clockwise manner, which draws the jaw members 3 laterally inward to a smaller hexagonally configured opening to accept smaller bolt sizes as depicted in FIG. 8. Counterclockwise rotation increases the radial position of the cam grooves 2*c*, 2*d* and 2*e*. This expands the jaw members 3 laterally outwards for larger bolt sizes as depicted in FIG. 7.

Figure 10:
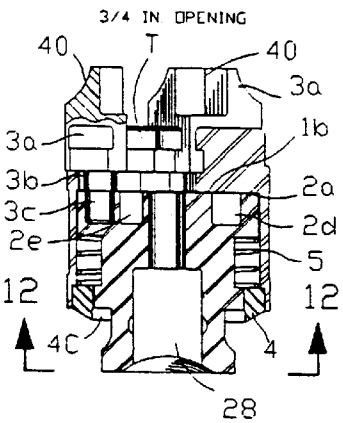
FIG. 10 is cross sectional view taken along line 10—10 of FIG. 7 showing the attached jaw members (¾ inch opening), barrel 1, core 2, index spring 5 and index collar 4 when engaged (locked position).
Figure 9:
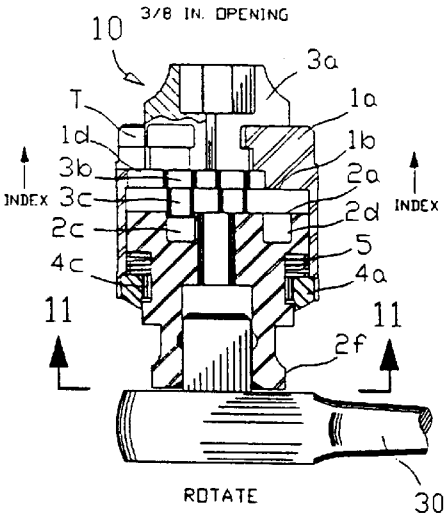
FIG. 9 is a cross sectional view taken along line 9—9 of FIG. 8 showing the attached jaw members 3 (⅜ inch opening), barrel 1, core 2, index spring 5 and index collar 4 when disengaged (unlocked position) with wrench attached.

There are thirty-six (36) equally spaced serrated male teeth 36 in the core 2 and thirty-six (36) female teeth 4*c* in the index collar 4. Each of the teeth in core 2 represents a distinct size when rotated and interlocked within the teeth 4*c* of the mating index collar 4. The center-to-center spacing of the serrated teeth 36 of core 2 corresponds with the center-to-center spacing of the socket size numbers N around core 2*b*. Consequently, with each 10° of rotation of the core 2, a number N moves into the window 12 and the radial position of the jaw members 3 relative to the radial position of the spirally configured cam grooves 2*c*, 2*d* and 2*e* is automatically adjusted to correspond with the selected socket size, because, as depicted in FIG. 9, the nipple ends 3*c* of the cam followers 3*b* remain within the cam grooves 2*c*, 2*d* and 2*e* even when the core 2 is in the unlocked mode. For example, if the selected N is ⅜ inch, the movement of the core 2 to position this number in the window 12 also results in the jaw members being positioned to receive a ⅜ inch head of a nut or bolt. Once a desired size is set, the user then releases the knurled exterior surface 2*f* of the drive core 2 and the spring 5 returns the core 2 to its locked position within the barrel 1, interlocking the serrated male teeth 36 with the serrated female teeth 4*c* of index collar 4. The top cam surface 2*a* of core 2 is now seated flush against wall 1*b* of barrel 1 as shown in FIG. 10. This assures that the jaw members 3 and the core 2 are secured within index collar 4 and barrel 1 as a unit. The socket 10 can now be safely utilized with a ⅜ inch drive ratchet which fits into a ⅜ inch square slot 28 provided in the center of core 2 of socket 10.

Second Embodiment

The second embodiment is similar in many respects to the first embodiment. Its main differences are the use of a snap-ring to hold assembled components together and a wavy spring in place of the coiled spring 5, restructuring of the top end of the barrel, and the elimination of the numbers N and rectangular window 12.

Figure 16:
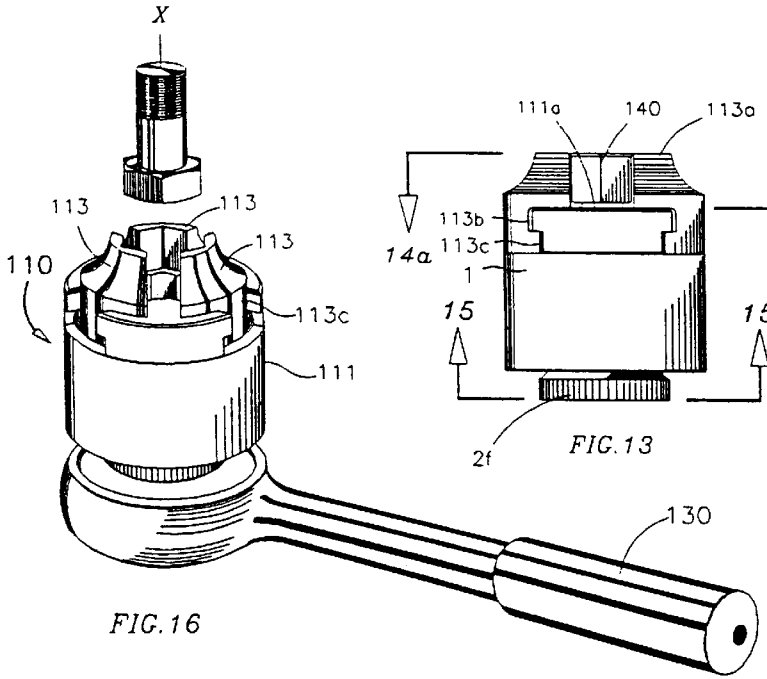
FIG. 16 is a perspective view of the second embodiment of the adjustable socket of the present invention attached to standard ratchet for turning the socket.
Figures 17, 18, 19A, 19B:
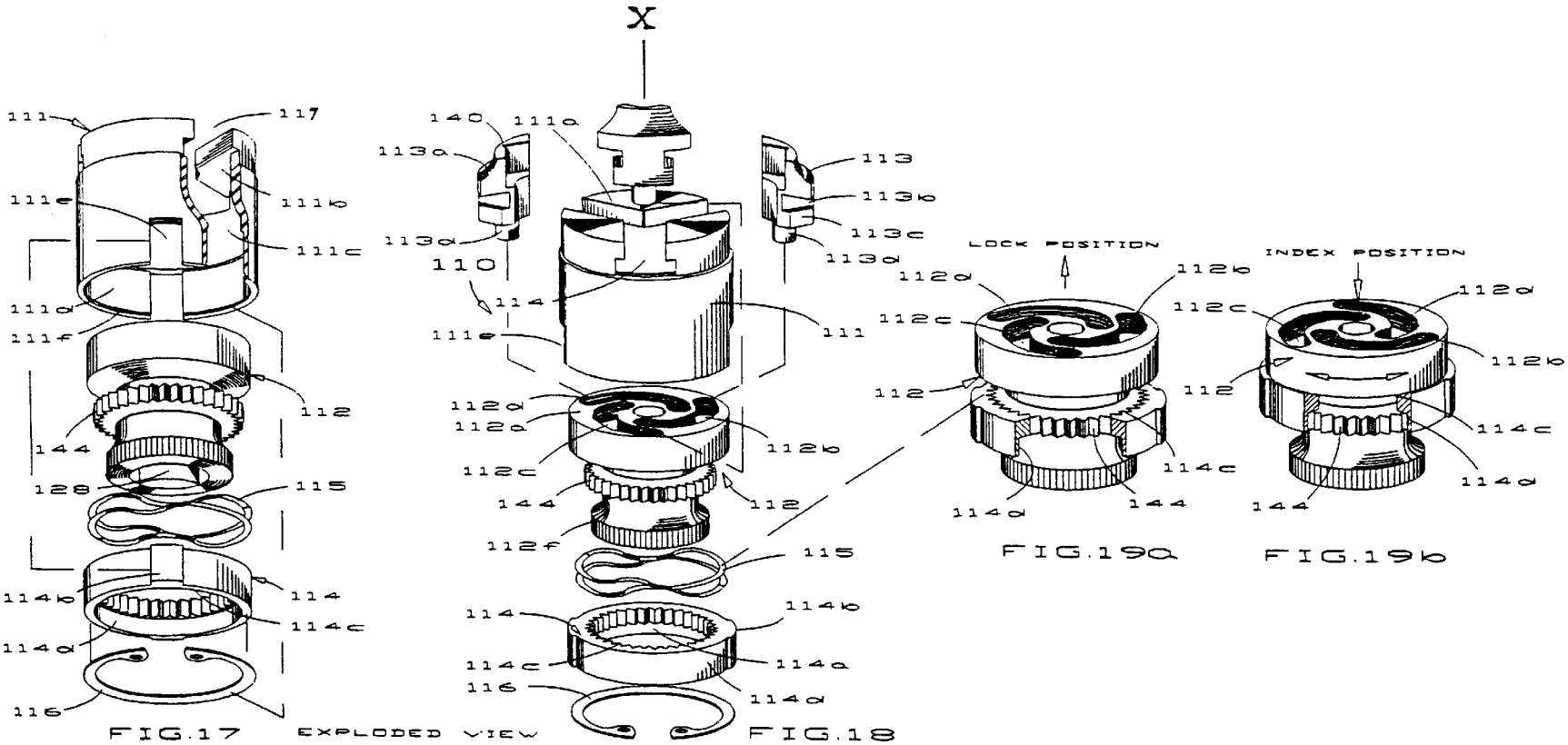
FIG. 17 is an exploded perspective view, looking upwards, at the barrel 111 cutaway showing its interior, core 112, index collar 114 and snap-ring 116.
FIG. 18 is an exploded perspective view, looking downwards, illustrating all of the components of the present socket invention.
FIG. 19*a* is a perspective view, with sections broken away, showing the drive core 112 in the locked position (wavy spring 115 not shown).
FIG. 19*b* is a perspective view, with section broken away, showing the drive core 112 in neutral or unlocked position (wavy spring 115 not shown).
Figure 24:
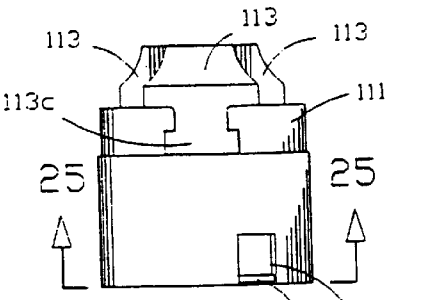
FIG. 24 is a side view of the socket barrel 111 and attached jaws 113.

As best shown in FIGS. 16 and 18, the second embodiment of this invention, the adjustable socket 110, includes (1) a hollow drive barrel 111, (2) three gripping jaws 113 carried by the drive barrel 111, (3) a drive core 112 having a top flat cam surface 112*a* with three spaced apart spirally configured cam slots 112*b*, 112*c* and 112*d* therein, (4) a wavy index spring 115, and (5) an index collar 114. In a locked position, the index collar 114 engages the drive core 112 and, in an unlocked position, disengages the drive core. Each gripping jaw 113 has a cam follower pin 113*d* that extends into one of the cam slots 112*b*, 112*c* and 112*d*.

Figure 23:
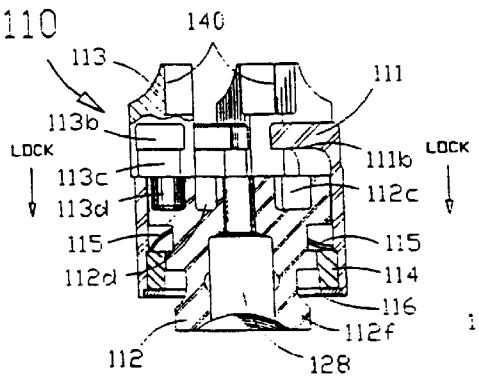
FIG. 23 is a cross-sectional view taken along lines 23—23 of FIG. 20 showing the socket components in a neutral or index position when the jaws 113 are adjusted to ¾ inch opening.
Figure 22:
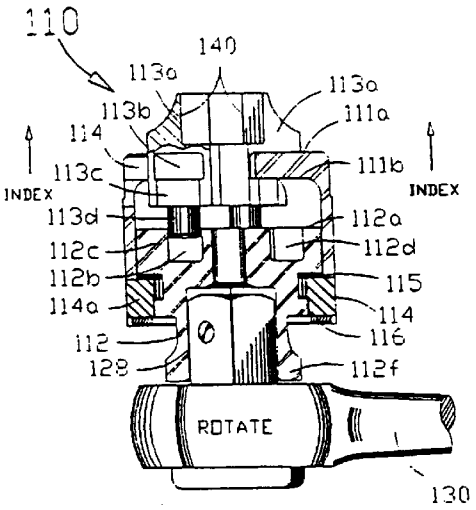
FIG. 22 is a cross-sectional view taken along lines 22—22 of FIG. 21 showing the socket components in a locked position when the jaws 113 are adjusted to ⅜ inch opening.

As best shown in FIGS. 22 and 23, the drive barrel 111, the drive core 112, the wavy index spring 115, and the index collar 114 are axially aligned along the longitudinal axis X of socket 110, with this axis X intersecting the center of each of these components of the socket. The gripping jaws 3*a* are radially displaced from the longitudinal axis X. The distance from the longitudinal axis X of these gripping jaws 113 varies depending on the size of the hexagonal head of the nut or bolt being grasped by the socket 110. The exterior bottom edge 112*f* of the drive core 112 is knurled to assist in gripping the socket 110 during size adjustments when the socket 110 is not attached to a ratchet wrench 130 (FIG. 16). The drive core 112 has forty-four (44) equally spaced serrated teeth 144 that engage the equally spaced forty-four (44) serrated teeth 114*c* of the collar 114 when the drive core 112 is placed in a locked position.

As best illustrated in FIG. 17, the central portion of barrel 111 is bored out in a manner that provides sufficient thickness of the end wall 111*b* to maintain structural integrity of barrel 111. Upon assembly, a bored out portion of barrel 111*c* houses the drive core 112 and wavy spring 115. The bored out portion of barrel 111*c* is counter-bored to provide a portion 111*d* having a diameter and depth adequate to house the index collar 114*a*. The counter-bore portion diameter 111*d* has two aligned notches 111*e* that interlock with two aligned ears 114*b* of the collar 114. The interlocking of the ears 114*b* in the slots 111*e* and a snap-ring 116 prevents slippage between the collar 114 and barrel 111 when the socket 110 is wrenched. At the end of the counter-bore portion 111*d* is a groove 111*f* that holds the snap-ring 116 that retains within the barrel 111 the core 112, the wavy spring 115, and the index collar 114.

Figure 14B:
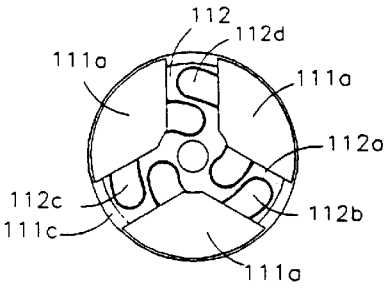
FIG. 14*b* is a cross sectional view taken along 14*b* of FIG. 13 with jaws removed, partially exposing the cam slots 112*c*, 112*d*, and 112*b* through three equally spaced slots formed at the top surface of barrel 111.
Figure 14A:
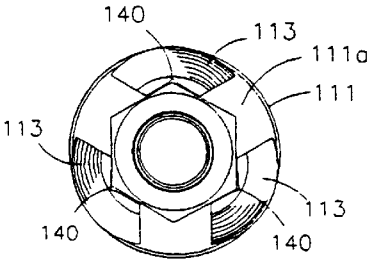
FIG. 14*a* is the top plan view of the second embodiment of the adjustable socket of the present invention taken along line 14*a* of FIG. 13 showing a three jaw configuration in the process of gripping a standard hexagonal bolt head.
Figure 25:
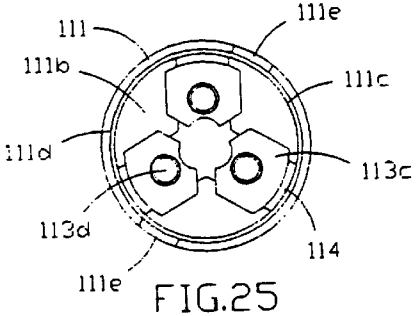
FIG. 25 is the underside view taken along line 25—25 of FIG. 24 looking up into the barrel interior showing the jaw neck portions 113*c* and follower pins 113*d*.

As best shown in FIG. 14*b*, the drive barrel 111 has at its top end three (3) equally spaced apart through T-shaped channels 117 in its top surface 111*a*. The wall 1*b* (FIG. 5) in the first embodiment has been eliminated in the second embodiment to improve the mounting and ease of lateral movement of the jaws, reduction in over all length of the second embodiment, and reduced manufacturing costs. The three jaws 113 are positioned within these T-channels 117 to move laterally. An inside recess portion of each jaw member 113 is formed into a 120 degree V-notch 140 to accommodate hexagonal configured nuts and bolts. The exterior surface 113*a* of each of the jaws 113 has a radius comparable to the cylindrical radius of the barrel 111, then tapering to a smaller diameter at its top to access nuts or bolts which may be fastened in a recessed area. An intermediate neck portion 113*c* of each jaw 113 has a T-shape that corresponds in shape to the T-shape of the channel 117 in which it rides laterally during adjustment. As best shown in FIG. 25, the neck portion 113*c* and the follower pin 113*d* of the jaws 113 extend through the inside end wall 111*b* of the barrel 111, and the follower pins 113*d* of jaws 113 extend and ride within one of the grooves 112*b*, 112*c* and 112*d* of core 112.

When a user pulls the core 112 downwards using the exterior bottom edge 112*f* of the drive core 112 to grasp the core, the serrated male teeth 144 of core 112 disengaged from the female teeth 114*c* of index collar 114 and the wavy spring 115 is compressed. The socket 110 is now changed from the locked mode (FIG. 19*a*) to an indexing or unlocked mode (FIG. 19*b*). In the unlocked mode, the drive core 112 is free to be manually rotated within barrel 111 and a counterbore 114*d* in the index collar 114. The counterbore 114*d* of the index collar 114 the maintains constant alignment of core 112 with the longitudinal axis X of socket 110.

Figure 15:
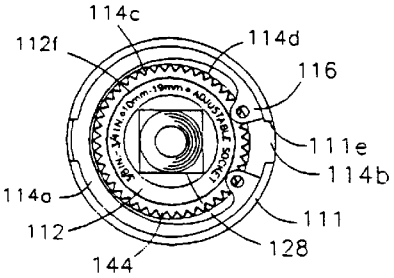
FIG. 15 is the bottom view taken along line 15—15 of FIG. 13 of the second embodiment of the adjustable socket of the present invention showing the ⅜ inch square drive slot 128 within core 112 and its serrated teeth engaged with the serrated teeth of index collar 114 and the retaining snap-ring 116.
Figure 13:
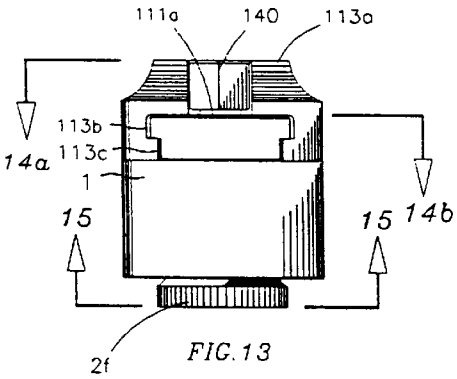
FIG. 13 is a side view of the second embodiment of the adjustable socket of the present invention.
Figure 20:
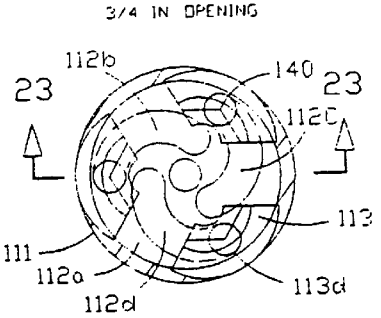
FIG. 20 is a top view illustrating in phantom the jaw members 113*a* set in cam slots 112*c*, 112*d*, 112*b* at ¾ opening.
Figure 21:
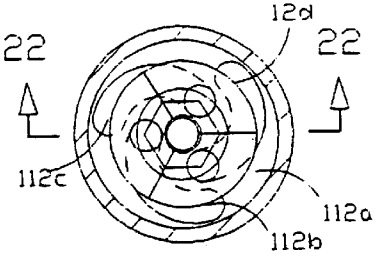
FIG. 21 is a top view illustrating in phantom the jaw members 3*a* set in cam slots 112*c*, 112*d*, 112*b* at ⅜ opening.
Figure 27:
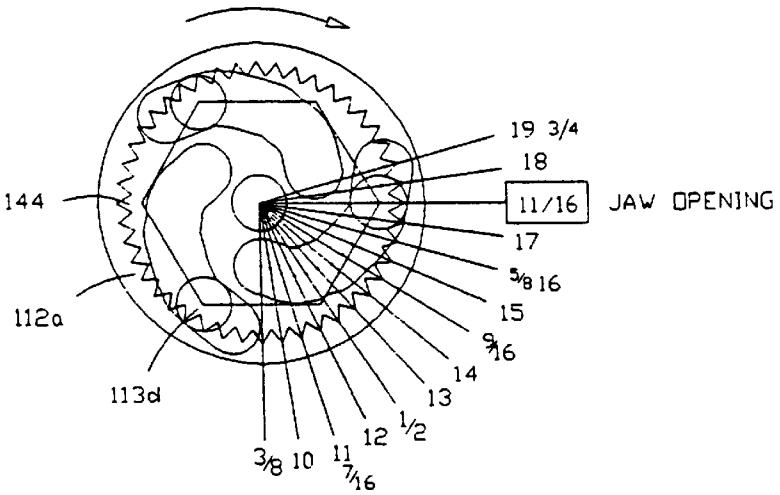
FIG. 27 is the same view as FIG. 26 except when core 112 is indexed to 11/16 inch opening.
Figure 26:
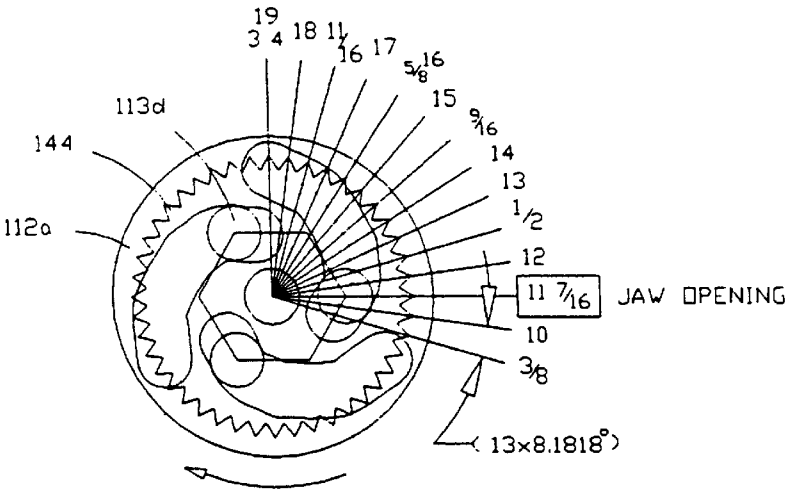
FIG. 26 is a top view illustrating in phantom the orientation of the serrated teeth 44 relative to the radial of the cam surfaces 112*b*, 112*c* and 112*d* of core 112 when adjusted to 7/16 inch opening.

As best shown in FIGS. 15, 22, and 23, the core 112 has a hollowed out ⅜ inch square receptacle 128 that accepts a standard ⅜ inch ratchet 130. If the socket 110 is mounted on a ratchet 130 and the user wants to make a size adjustment, he or she places the jaws 113 on the bolt head or nut, pulling the barrel 111 upwards while simultaneously rotating the ratchet handle so that the jaws 113 fit onto the particular size bolt being wrenched. As best shown in FIGS. 19*b* and 22, the spring 115 is thereby compressed and the teeth 114*c* of the collar 114 and the teeth 144 of the core 112 engage. This allows the user to turn the core 112 and move the relative positions of the pins 113*d* in the grooves 112*b*, 112*c*, and 112*d* to select the hex size. As depicted in FIGS. 21 and 26, the radial positions of the cam grooves 112*b*, 112*c* and 112*d* change when the drive core 112 is rotated in a clockwise manner to draw the jaw members 113 laterally inward to a smaller hex configured opening for accepting smaller hex sizes. As depicted in FIGS. 20 and 27, counterclockwise rotation changes the radial position of the cam grooves 112*b*, 112*c* and 112*d* to expand the jaw members 113 laterally outward for larger hex sizes.

After making this selection, the user then releases the barrel 111. This puts the socket 110 in the locked position, and the user is now ready to either tighten or loosen the bolt or nut safely. The wavy spring 115 is seated within barrel counter bore portion 111*c*, surrounding the serrated teeth 144 between the head of the core 112 and the index collar 114. As best shown in FIGS. 19*a* and 23, this spring 115, in its flexed or decompressed condition, provides a force that separates the teeth 144 of the core 112 and from the teeth 114*c* of the index collar 114, thereby holding the jaws 113 in the selected position. The pins 113*d* are in constant engagement with the spiral shaped cam slots 112*b*, 112*c* and 112*d* of core 2, even during the index mode.

As best shown in FIGS. 26 and 27, each of the serrated teeth 144 on the core 112 represents a distinct hex size when rotated, tooth-by-tooth, and interlocked with the teeth 114*c* of the mating index collar 114. The center-to-center spacing of the serrated teeth 144 on the core 112 and the serrated teeth 114*c* on the index collar 114 is the same ratio with the radial proportion of the cam slots 112*b*, 112*c* and 112*d*. Consequently, each 8.1818 degree of index rotation of the core 112, relative to the radial position of the cam slots 112*b*, 112*c* and 112*d*, corresponds to the radial opening of the jaw members 3*a*. The adjustable socket 110 has a range of seventeen discrete sizes in both English and Metric units from ⅜ inch to ¾ and 10 mm (millimeter) to 19 mm in sequential order. Because some of the sizes are meet ANSI specifications, they have been incorporated into one size setting. The range is as follows: ⅜ inch, 10 mm, 11 mm/7/16 inch, 12 mm, ½ inch, 13 mm, 14 mm, 9/16 inch, 15 mm, ⅝ inch /16 mm, 17 mm, 11/16 inch, 18 mm and 19 mm/¾ inch.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention:

I claim:

1. An adjustable socket with a number of selectable socket size openings available, including a drive member having a longitudinal axis, a top end at least partially closed by a wall, and an open bottom end, an indexing collar positioned within the drive member near said bottom end, said indexing collar having a series of teeth, an axially moveable drive core positioned within the drive member beneath the closed wall of the drive member, said drive core being manually rotatable to different positions corresponding to the selected socket size openings, along a side wall of the drive core a series of teeth and at a top end of said drive core a cam surface with guide elements, said cam surface being substantially at a right angle to the longitudinal axis, a plurality of jaw members mounted to the top end of the drive member to move laterally between fixed lateral positions upon rotation of the drive core, each fixed lateral position corresponding to a selected socket size opening, each jaw member having a cam follower extending therefrom that engages one of the guide elements in the cam surface, with said drive core in a first axial position being enabled to be rotated, thereby causing the jaw members to move laterally to a selected socket size, and in a second axial position said teeth of the drive core and the teeth of the indexing collar being interlocked to maintain the selected socket size.

2. The adjustable socket of claim 1 where there are visible indicia associated with each selectable position to indicate the selected socket size openings.

3. The adjustable socket of claim 1 where the guide elements are arranged in a spiral configuration.

4. The adjustable socket of claim 1 where the cam surface is substantially flat and the guide elements are slots in the flat cam surface.

5. The adjustable socket of claim 1 where there is a spring member that normally forces the drive core and the indexing collar into a position where the teeth of the drive core and the teeth of the indexing collar engage.

6. An adjustable socket with a number of selectable socket size openings available, including a drive member, an indexing member coupled to the drive member, said indexing member having a series of teeth, an axially moveable drive core positioned within the drive member and interactive with the indexing member, said drive core being manually rotatable to different positions corresponding to the selected socket size openings, on the drive core a series of teeth and a cam surface with guide elements, a plurality of jaw members mounted to the drive member to move laterally between fixed lateral positions upon rotation of the drive core, each fixed lateral position corresponding to a selected socket size opening, each jaw member having a cam follower that engages one of the guide elements in the cam surface, with said drive core in a first axial position being enabled to be rotated, thereby causing the jaw members to move laterally to a selected socket size, and in a second axial position said teeth of the drive core and the teeth of the indexing collar being interlocked to maintain the selected socket size.

7. The adjustable socket of claim 6 where there are visible indicia associated with each selectable position to indicate the selected socket size openings.

8. The adjustable socket of claim 6 where the guide elements are arranged in a spiral configuration.

9. The adjustable socket of claim 6 where the guide elements are slots in the flat cam surface.

10. The adjustable socket of claim 6 where there is a spring member that normally forces the drive core and the indexing member into a position where the teeth of the drive core and the teeth of the indexing collar engage.

11. An adjustable socket with a number of selectable socket size openings available, including a cylindrical, hallow drive member having a longitudinal axis, a top end closed at least partially by a wall with a plurality of slots therein, and an open bottom end, a ring shaped indexing collar positioned within the drive member near said bottom end, said indexing collar having a central opening with an inner circular surface with a series of teeth thereon, an axially moveable drive core positioned beneath the closed wall of the drive member that is manually rotatable to different positions corresponding to the selected socket size openings, and having a lower wall portion extending into the central opening of the indexing collar and a head portion that fits snugly within the drive member, said head portion having a cam surface with guide elements, said cam surface being substantially at a right angle to the longitudinal axis, said lower wall portion of the drive core having a series of teeth adapted to disengage the teeth on the inner circular surface when the drive core is in a first axial position and to engage the teeth on the inner circular surface when the drive core is in a second axial position, a plurality of jaw members mounted to the top end of the drive member to move laterally between fixed lateral positions upon rotation of the drive core, each fixed lateral position corresponding to a selected socket size opening, each jaw member having a cam follower extending therefrom that engages one of the guide elements in the cam surface, with said drive core in the first axial position being enabled to be rotated, thereby causing the jaw members to move laterally to a selected socket size, and in the second axial position said teeth of the drive core and the teeth of the indexing collar being interlocked to maintain the selected socket size, and a spring member that normally forces the drive core and the indexing collar into the second position where the teeth of the drive core and the teeth of the indexing collar engage.

* * * * *